US006696905B2

(12) United States Patent
Umeda et al.

(10) Patent No.: US 6,696,905 B2
(45) Date of Patent: Feb. 24, 2004

(54) DIELECTRIC FILTER DEVICE HAVING PERPENDICULAR BORES FOR IMPROVED PASS BAND CHARACTERISTICS

(75) Inventors: Katsumi Umeda, Katano (JP); Takaaki Uchiyama, Higashiosaka (JP); Kenichi Ezaki, Daito (JP)

(73) Assignees: Sanyo Electric Co., Ltd., Osaka (JP); Sanyo Electronic Components Co., Ltd., Osaka (JP)

( * ) Notice: Subject to any disclaimer, the term of this patent is extended or adjusted under 35 U.S.C. 154(b) by 0 days.

(21) Appl. No.: 10/230,397

(22) Filed: Aug. 29, 2002

(65) Prior Publication Data

US 2003/0197580 A1 Oct. 23, 2003

(30) Foreign Application Priority Data

Apr. 23, 2002 (JP) ..... 2002-121363

(51) Int. Cl.[7] ..... H01P 1/20; H01P 3/06; H01P 5/12

(52) U.S. Cl. ..... 333/206; 333/134

(58) Field of Search ..... 333/202, 206, 333/134, 203; 343/702, 909

(56) References Cited

U.S. PATENT DOCUMENTS 5,831,495 A * 11/1998 Hino ..... 333/202

FOREIGN PATENT DOCUMENTS

| | | |
|---|---|---|
| JP | 3205337 | 6/2001 |
| WO | WO 93/24968 | 12/1993 |

* cited by examiner

*Primary Examiner*—Patrick Wamsley
(74) *Attorney, Agent, or Firm*—Armstrong, Kratz, Quintos, Hanson & Brooks, LLP

(57) ABSTRACT

The invention provides a dielectric filter device comprising a first electrode formed on a dielectric block for connection to an antenna, and a second electrode formed on an upper surface of the block for connection to a communications device, openings of hollow bores being arranged between the first and second electrodes to provide a filter for passing a predetermined frequency band, a plurality of hollow bores being arranged between the second electrode and a side surface of the block to provide traps having a plurality of attenuation poles. Attenuation of frequencies in the pass band can be diminished without providing an external circuit.

4 Claims, 5 Drawing Sheets

DIELECTRIC FILTER DEVICE HAVING PERPENDICULAR BORES FOR IMPROVED PASS BAND CHARACTERISTICS

FIELD OF THE INVENTION

The present invention relates to dielectric filter devices for determining the frequency band pass characteristics to be used in mobile communications devices or the like.

BACKGROUND OF THE INVENTION

It is generally known that monoblock-type dielectric filters are used in mobile communications devices for transmitting and receiving signals, for example, in the frequency band of hundreds of megahertz to several gigahertz. Mobile communications devices, such as portable telephones, in recent years are adapted to serve a multiplicity of functions and made more compact and lightweight, and many monoblock-type dielectric duplexers are singly adapted to process different transmission and receiving frequencies for use in such devices (for example, Japanese Patent No. 3205337).

An example of duplexer which is such a conventional dielectric filter of the monoblock type will be described with reference to FIG. 5. A dielectric block 10, for example, of a ceramic material or the like has hollow bores 40 to 44, 49, 50. Electrically conductive layers are formed on the outer peripheral side surface 20 of the block and the upper surface thereof around the openings of the bores as indicated at 33 to 39. Further provided on the upper surface are a first electrode 30, second electrode 31 and third electrode 32 which are separate from these conductive layers.

As shown in FIG. 5, the bores 40, 41 are arranged between the first electrode 30 and the second electrode 31. The bore 49 is positioned between the second electrode 31 and the peripheral side surface. The bores 42 to 44 are arranged between the first electrode 30 and the third electrode 32. The bore 50 is positioned between the third electrode 32 and the peripheral side surface 20. The first electrode 30 is connected to an antenna (not shown), the second electrode 31 to a transmitter, and the third electrode 32 to a receiver.

A band-pass filter for the desired transmission frequency band is provided by suitably adjusting the dimensions and shapes (e.g., the diameter and depth of bores, and distance between conductive layers) of the bores 40, 41 between the first and second electrodes 30, 31 and the conductive layers 33, 34 in the vicinity of openings of these bores. A trap having an attenuation pole at the desired frequency in the vicinity of the above-mentioned transmission frequency band can be provided by suitably adjusting the dimensions and shapes of the bore 49 between the second electrode 31 and the conductive layer on the peripheral side surface 20 and the conductive layer 38 in the vicinity of opening of the bore Similarly, a predetermined band-pass filter for the receiving frequency band is provided by suitably adjusting the dimensions and shapes of the bores 42 to 44 between the first and third electrodes 30, 32 and the conductive layers 35 to 37 in the vicinity of openings of these bores. A trap having an attenuation pole in the vicinity of the receiving frequency band can be provided by suitably adjusting the shapes of the bore 50 between the third electrode 32 and the conductive layer on the peripheral side surface and the conductive layer 39 in the vicinity of opening of the bore.

The dielectric duplexer described comprises two dielectric filters having two systems, i.e., transmitting system and receiving system, which use different frequencies. Since the filters are based on the same principles of the band-pass function and the trap function, these functions will be described with respect to the receiving system with reference to the filter characteristics diagrams of FIGS. 7 and 8.

FIG. 8 shows the characteristics of the band-pass filter which is capacitance-coupled by the bores provided between the first electrode and the third electrode and the conductive layers in the vicinity of these bores. The shapes of these bores and the conductive layers in the vicinity of the openings thereof are so adjusted as to provide the desired frequency pass band f1 to f2. Ideally, it is desirable that the attenuation be as great as possible in the suppressing band outside the pass band, whereas in actuality, a sharp attenuation is not available at a frequency in the suppressing band near the pass band.

In communications devices, however, it is likely that a frequency near the pass band will also be used, for example, for processing signals in the receiver provided subsequent to the filter. In such a case, the receiving filter needs to have such attenuation characteristics that in the range of from the frequency f2 at the pass-band limit to a frequency f4 which is used for other signal transmission or receiving, the attenuation is at least a (dB) for example at a frequency of f3 and at least b (dB) at the frequency f4. With reference to FIG. 8, the attenuation of the receiving filter is smaller than b (dB) at the frequency f4 for other use, and there arises the problem that a sufficiently great S/N ratio is not available.

Accordingly with the conventional filter shown in FIG. 5, the bore 50 between the third electrode 32 and the conductive layer on the peripheral side surface and the conductive layer 39 near the opening of the bore are suitably adjusted in shape to thereby provide a trap having an attenuation pole, i.e., a great attenuation of c (dB), for example, in the vicinity of the frequency f3, and an attenuation of b (dB) also at a frequency over the frequency f4 shown in FIG. 7.

This method nevertheless requires an increased attenuation at f3, such that an attenuation occurs also near the frequency f2 within the required pass band as indicated at d. The same is also true of the transmission side including the first and second electrodes 30, 31.

In the field of mobile communications devices such as portable telephones, it is required in recent years that the parts be made ever smaller. Since mobile phones need to be highly portable as an important feature of the commercial product and must therefore be smaller in size, it is not desirable to provide improved filter characteristics by adding new circuit components to the dielectric filter described.

SUMMARY OF THE INVENTION

To overcome the foregoing problems, the present invention provides a dielectric filter device comprising a dielectric block generally in the form of a rectangular parallelepiped and having a plurality of hollow bores formed therein and openings of the bores in an upper surface of the block, electrically conductive layers respectively covering a lower surface opposed to the upper surface, an outer peripheral side surface parallel to axes of the bores, inner peripheral surfaces defining the respective bores and the upper surface around the bore openings, and a plurality of electrodes separate from the conductive layers for connection to external devices. First bore opening portions are arranged between the first electrode formed on the upper surface or side surface of the block and the second electrode formed on the upper surface thereof to provide a filter for passing a predetermined frequency band, second bore opening portions being arranged between the second electrode and the side surface of the block.

In the dielectric filter device described, the second bore opening portions are preferably arranged perpendicular to the direction of arrangement of the first bore opening portions.

The invention described gives improved characteristics to the dielectric filter without providing external components on the filter.

DETAILED DESCRIPTION OF EMBODIMENTS

Figure 1:
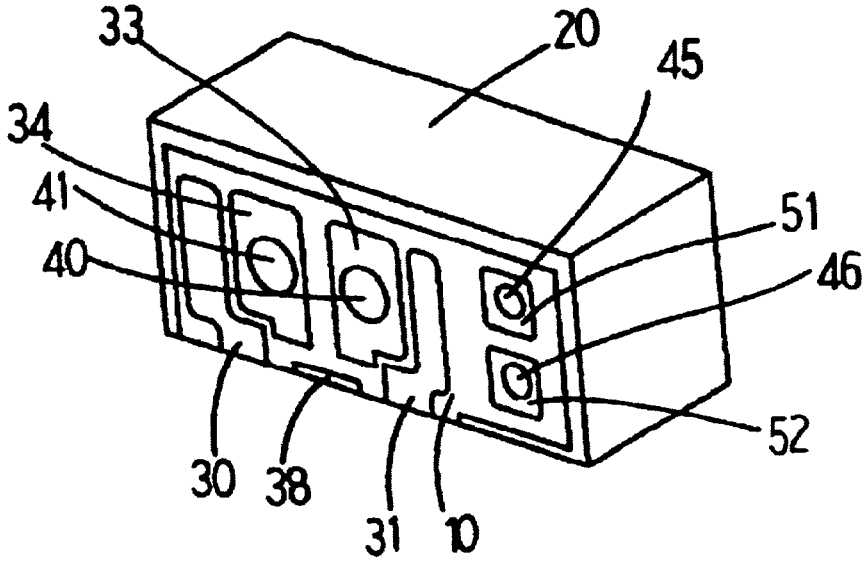
FIG. 1 is a perspective view showing a dielectric filter of the present invention.

Embodiments of the present invention will be described below with reference to FIGS. 1 to 4. The dielectric filter which is the basic device of the invention comprises a dielectric block 1 prepared from a ceramic material or the like and having hollow bores 40, 41, 45, 46, Conductive layers are formed on the outer peripheral side surface 20 of the block 1 and in the vicinity of openings of the bores in the upper surface thereof as indicated at 33, 34, 51, 52. A first electrode 30 and a second electrode 31 which are electrically separate from the conductive layers are formed on the upper surface.

The bores 40, 41 are arranged between the first and second electrodes 30, 31. Provided between the second electrode 31 and the peripheral side surface are hollow bores 45, 46 which are arranged perpendicular to the direction of arrangement of the bores 40, 41 between the first and second electrodes 30, 31. While the present embodiment is usable as a transmitting filter or a receiving filter, the embodiment will be described for use as the receiving filter.

The first electrode 30 is connected to an antenna (not shown), and the second electrode 31 to a receiver. A band-pass filter is provided by the bores 40, 41 arranged between the first and second electrodes 30, 31 and the conductive layers 33, 34 in the vicinity of the openings of the bores. The frequencies of the desired pass band are determined by suitably adjusting the shape of the bores and the shape of the conductive layers. The conductive layer 38 is capacitance-coupled to the bores 40, 41 to adjust the frequencies of the pass band. The bores 45, 46 between the second electrode 31 and the conductive layer on the peripheral side surface 20 provide a trap for the second electrode, near frequencies of the pass band. The near-by frequency is determined by suitably adjusting the shape of the bores and the shape of the conductive layers.

More preferably, the bores 45, 46 between the second electrode 31 and the conductive layer on the peripheral side surface 20 are arranged perpendicular to the direction of arrangement of the bores 40, 41 between the first and second electrodes 30, 31.

Figure 6:
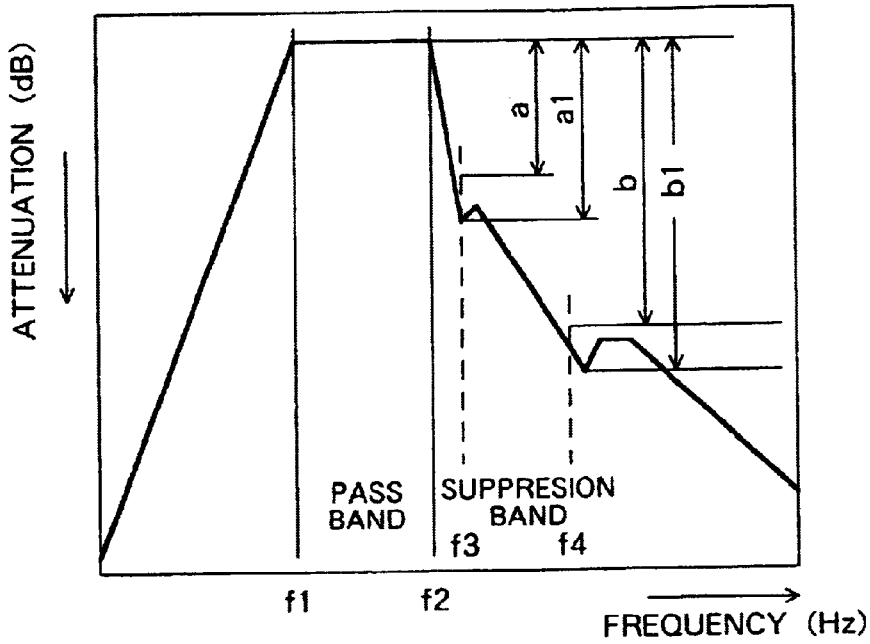
FIG. 6 is a graph showing the characteristics of the dielectric filter of the invention.
Figure 7:
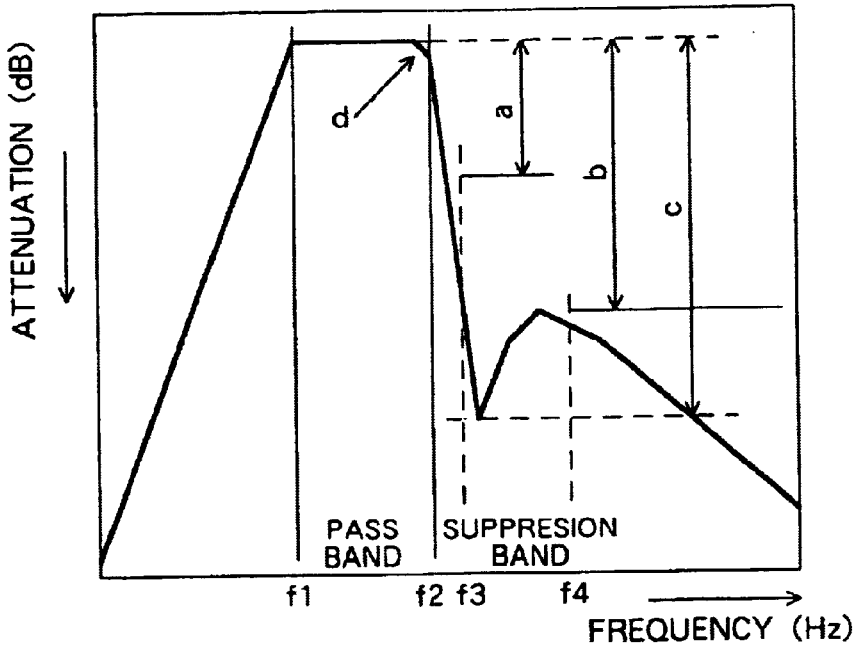
FIG.7 Prior Art
FIG. 7 is a graph showing the characteristics of the conventional dielectric filter.
Figure 8:
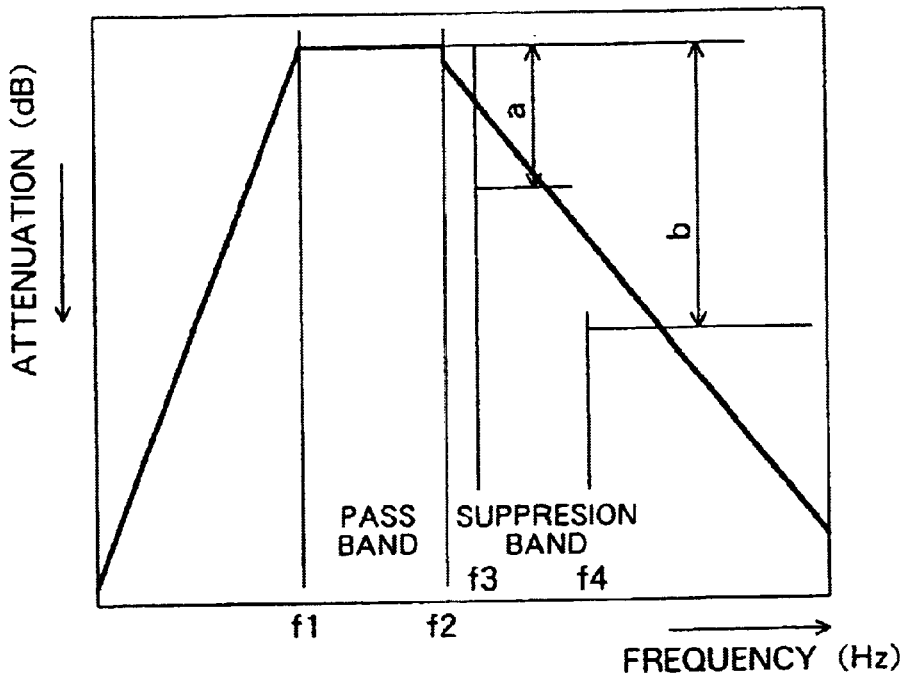
FIG.8 Prior Art
FIG. 8 is a graph showing the characteristics of the conventional dielectric filter.

The characteristics of the dielectric filter of FIG. 1 are shown in FIG. 6. According to this embodiment, two poles can be formed in the higher suppression band outside the pass band as shown in FIG. 6 by providing the plurality of bores 45, 46 between the second electrode 31 and the conductive layer on the outer peripheral side surface. With reference to the prior art shown in FIGS. 7 and 8, when the characteristics required involve an attenuation of at least a (dB) at a frequency f3 and an attenuation of at least b (dB) at a frequency f4, there arises a need for a trap providing a great attenuation of c (dB) near the frequency f3 to cause an undesirable attenuation at the portion d of the pass band.

However the present embodiment has two attenuation poles such that a trap of a1 (dB) slightly greater than the attenuation a (dB) is provided near the frequency f3, and a trap of b1 slightly grater than the attenuation b (dB) is provided at f4 to thereby minimize the attenuation (indicated at d in FIG. 7) due to the influence of trap in the pass band.

Furthermore, the bores 45, 46 between the second electrode 31 and the conductive layer on the peripheral side surface 20 are arranged perpendicular to the direction of arrangement of the bores 40, 41 between the first and second electrodes 30, 31, so that these bores can be provided without increasing the size of the filter.

Figure 2:
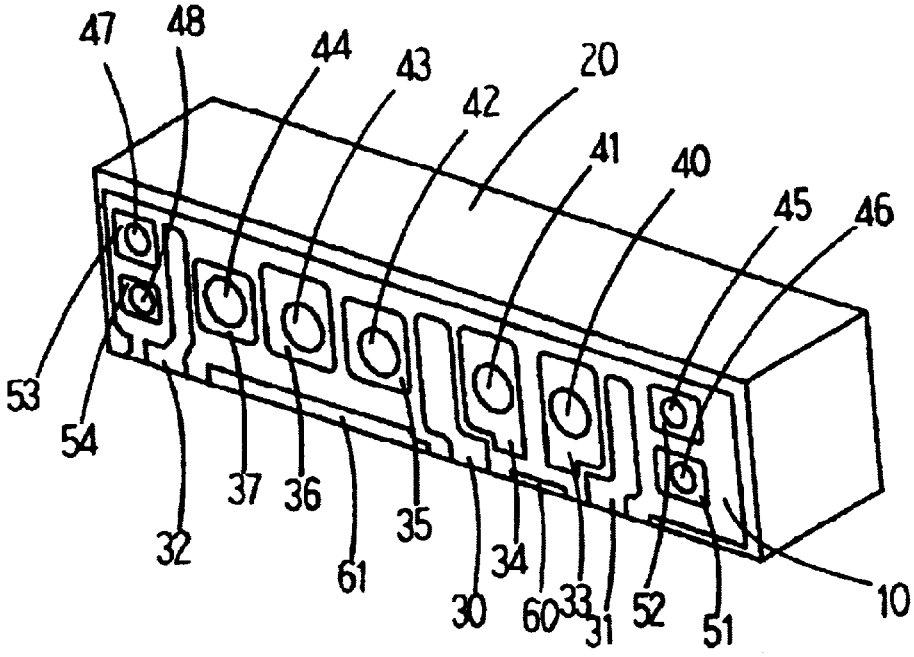
FIG. 2 is a perspective view showing a duplexer comprising the dielectric filter of FIG. 1.
Figure 3:
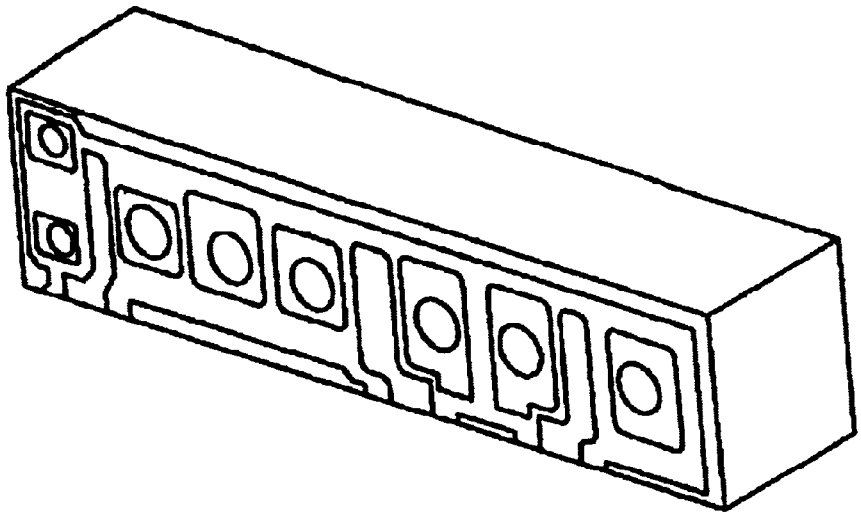
FIG. 3 is a perspective view showing another embodiment of duplexer comprising the dielectric filter of FIG. 1.
Figure 4:
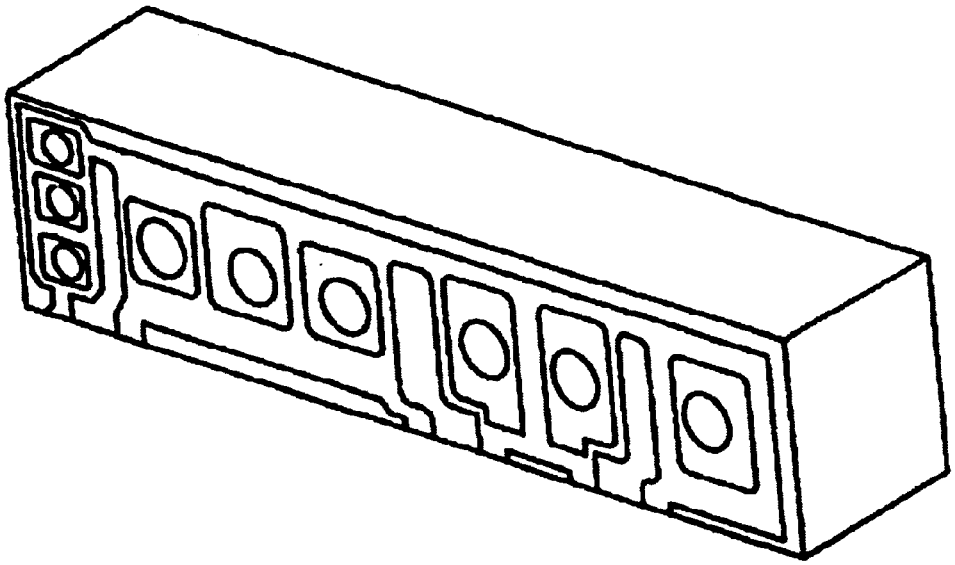
FIG. 4 is a perspective view showing another embodiment of duplexes comprising the dielectric filter of FIG. 1.
Figure 5:
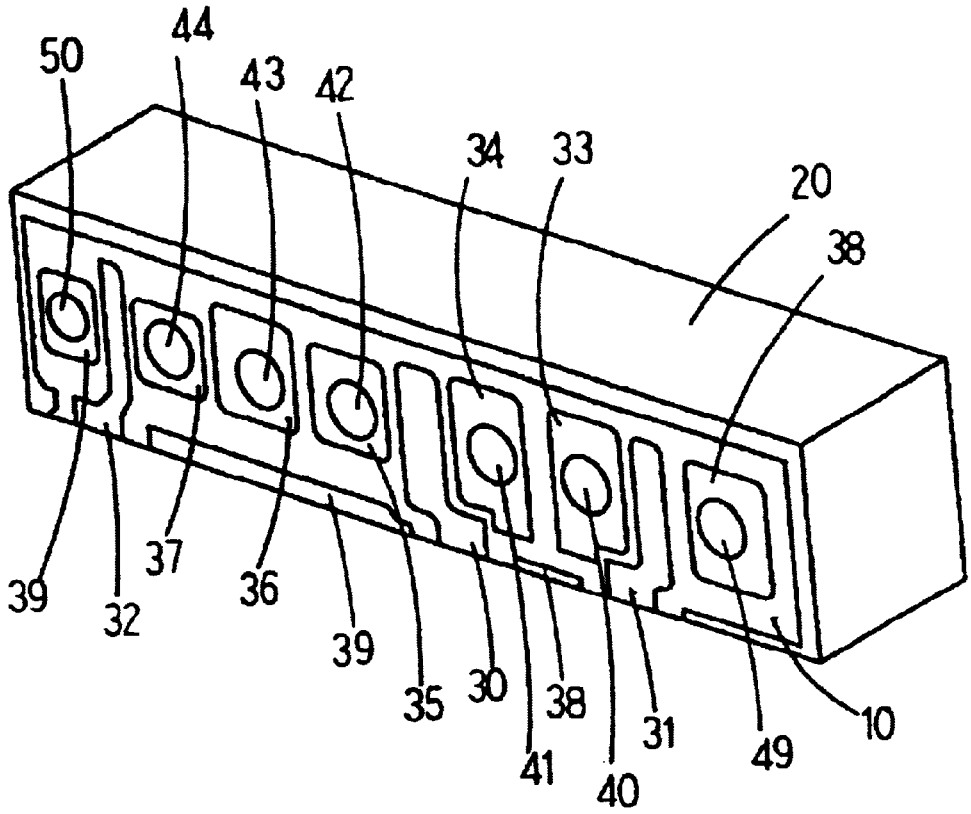
FIG.5 Prior Art
FIG. 5 is a perspective view showing a conventional dielectric filter.

FIG. 2 shows a dielectric duplexer which comprises two dielectric filters of FIG. 1. A plurality of hollow bores 40, 41 are arranged between a first electrode 30 and a second electrode 31. A plurality of hollow bores 45, 46 are arranged between the second electrode 31 and an outer peripheral side surface. Further a plurality of hollow bores 42 to 44 are arranged between the first electrode 30 and a third electrode 32, and a plurality of hollow bores 47, 48 are arranged between the third electrode 32 and the outer peripheral side surface 20.

For example, the first electrode 30 is connected to an antenna (not shown), the second electrode 31 to a transmitter, and the third electrode 32 to a receiver. A band-pass filter of the desired transmission frequency band is provided by suitably adjusting the dimensions and shapes (e.g., the diameter and depth of bores, and distance between conductive layers) of the bores 40, 41 between the first and second electrodes 30, 31 and the conductive layers 33, 34 in the vicinity of openings of these bores and thereby providing capacitance-coupled resonators. Traps having attenuation poles at two desired frequencies in the vicinity of the above-mentioned transmission frequency band can be provided by suitably adjusting the shapes of the bores 45, 46 between the second electrode 31 and the conductive layer on the peripheral side surface 20 and the conductive layers 51, 52 in the vicinity of openings of the bores.

Similarly, a predetermined band-pass filter for the receiving frequency band is provided by suitably adjusting the dimensions and shapes of the bores 42 to 44 between the first and third electrodes 30, 32 and the conductive layers 35 to 37 in the vicinity of openings of these bores. Traps having two attenuation poles in the vicinity of the receiving frequency band can be provided by suitably adjusting the shapes of the bores 47, 48 between the third electrode 32 and the conductive layer on the outer side surface and the conductive layers 53, 54 in the vicinity of openings of the bores. As is the case with the dielectric filter of FIG. 1 described, the attenuation in the transmission and receiving pass bands can be minimized.

The device of the present invention is not limited to the foregoing embodiments in construction but can be modified variously within the technical scope defined in the appended claims.

What is claimed is:

1. A dielectric filter device comprising a dielectric block generally in the form of a rectangular parallelepiped and having a plurality of hollow bores formed therein and openings of the bores in an upper surface of the block, electrically conductive layers respectively covering a lower surface opposed to the upper surface, an outer peripheral side surface parallel to axes of the bores, inner peripheral surfaces defining the respective bores and the upper surface around the bore openings, and a plurality of electrodes separate from the conductive layers for connection to external devices, the filter device being characterized in that first bore opening portions are arranged between the first electrode formed on the upper surface or side surface of the block and the second electrode formed on the upper surface thereof to provide a filter for passing a predetermined frequency band, second bore opening portions being arranged between the second electrode and the side surface of the block.

2. A dielectric filter device according to claim 1 wherein the second bore opening portions are arranged perpendicular to the direction of arrangement of the first bore opening portions.

3. A dielectric filter device comprising a dielectric block generally in the form of a rectangular parallelepiped and having a plurality of hollow bores formed therein and openings of the bores in an upper surface of the block, electrically conductive layers respectively covering a lower surface opposed to the upper surface, an outer peripheral side surface parallel to axes of the bores, inner peripheral surfaces defining the respective bores and the upper surface around the bore openings, and a plurality of electrodes separate from the conductive layers for connection to external devices, the filter device being characterized in that first bore opening portions are arranged between the first electrode formed on the upper surface or side surface of the block and the second electrode formed on the upper surface thereof to provide a first filter for passing a predetermined first frequency band, second bore opening portions being arranged between the first electrode and the third electrode formed on the upper surface to provide a second filter for passing a predetermined second frequency band, third bore opening portions being arranged on the upper surface of the block between the second electrode and the outer peripheral side surface of the block, and/or fourth bore opening portions being arranged between the third electrode and the side surface of the block.

4. A dielectric filter device according to claim 3 wherein the first and second bore opening portions are arranged on a straight line, and the third bore opening portions and/or the fourth bore opening portions are arranged perpendicular to the direction of arrangement of the first and second bore opening portions.

* * * * *